United States Patent [19]

Zoladz

[11] Patent Number: 4,709,828

[45] Date of Patent: Dec. 1, 1987

[54] TWO-PART TRANSFORMER CASTING HAVING LIQUID-TIGHT SEAL

[75] Inventor: Frank J. Zoladz, Morristown, Tenn.

[73] Assignee: North American Philips Consumer Electronics Corp., Knoxville, Tenn.

[21] Appl. No.: 842,055

[22] Filed: Mar. 18, 1986

Related U.S. Application Data

[63] Continuation of Ser. No. 746,488, Jun. 19, 1985.

[51] Int. Cl.[4] ..... B65D 6/34

[52] U.S. Cl. ..... 220/76; 220/81 R; 220/85 TC; 220/80

[58] Field of Search ..... 220/76, 3.8, 75, 80, 220/81 R, 85 TC; 174/50; 336/90, 96

[56] References Cited

U.S. PATENT DOCUMENTS

| | | | |
|---|---|---|---|
| 2,128,093 | 8/1938 | James | 220/85 TC |
| 2,183,757 | 12/1939 | Graaf | 220/75 |
| 2,259,382 | 10/1941 | Ingels | 220/76 |
| 2,343,106 | 2/1944 | Carney | 220/75 |
| 2,590,803 | 3/1952 | Unger et al. | 220/85 TC |
| 2,720,332 | 10/1955 | Holt | 220/76 |
| 3,108,710 | 10/1963 | Lange et al. | 220/76 |
| 3,225,954 | 12/1965 | Herrick et al. | 220/75 |
| 3,854,269 | 12/1974 | Hancock | 220/76 |
| 3,864,813 | 2/1975 | Morjan | 220/75 |
| 3,910,450 | 10/1975 | Hammes | 220/75 |
| 4,113,130 | 9/1978 | Lazenby et al. | 220/75 |
| 4,455,355 | 6/1984 | Inui et al. | 220/75 |

FOREIGN PATENT DOCUMENTS

| | | | |
|---|---|---|---|
| 2410963 | 9/1974 | Fed. Rep. of Germany | 220/3.8 |
| 1244993 | 9/1959 | France | 220/75 |
| 408460 | 12/1944 | Italy | 220/75 |
| 2157 | of 1883 | United Kingdom | 220/75 |

*Primary Examiner*—Joseph Man-Fu Moy

*Attorney, Agent, or Firm*—Thomas A. Briody; William J. Streeter; Marianne R. Rich

[57] ABSTRACT

A liquid-tight seal is achieved in a two-part transformer casing by use of a U-shaped channel in the main body of the casing, the U-shaped channel being formed on one side by a rigid joint member and, on the other side, by a flexible member. Both members are molded in a single unit with the main casing, but the flexible member has a decreased cross-section relative to that of the rigid member. The cover for the casing has a lip extending into the U-shaped channel. The lip is wegge-shaped, having a minimum cross-sectional area at its furthest projection into the U. At its other extremity, the cross-sectional height of the lip slightly exceeds the perpendicular distance between the flexible and rigid members. A rectangular cross-sectional part of the lip immediately adjacent to the cover provides a contact surface for the flexible member, while the rigid member makes contact with the wedge-shaped portion over a greater area. The flexible member thus pushes the lip against the rigid member and, further, provides a backup seal should liquid pass through the seal between the lip and the rigid member.

9 Claims, 4 Drawing Figures

TWO-PART TRANSFORMER CASTING HAVING LIQUID-TIGHT SEAL

This is a continuation of application Ser. No. 746,488 filed 6-19-85.

FIELD OF THE INVENTION

The present invention relates to two-part transformer casings for high voltage communications transformers and, more particularly, to two-part casings receiving hot liquid potting material in the course of manufacture.

BACKGROUND OF THE INVENTION

The standard two-part transformer casings now in use for high voltage transformers in the communications field consist of a main casing which has a groove or channel of rectangular cross-section into which the cover is slidably inserted. During manufacture, hot liquid potting material, e.g. epoxy, is poured into the case which is then subjected to a vacuum to remove entrapped air. In the past, leakage around the casing-cover seal occurred frequently during this process. To eliminate such leakage, sealers or adhesives were necessary which added to the cost of production.

SUMMARY OF THE INVENTION

It is an object of the present invention to provide a transformer casing in which a liquid-tight mechanical seal is achieved when one part is slid into the other, without use of any additional sealing material.

It is a further object of the present invention to accomplish this end without departing from the material presently in use and without departing from the molding technique now used to manufacture both parts of the casing.

In accordance with the invention, the transformer casing has a first part having a channel adapted to receive a second part slidably inserted therein. The channel has a substantially U-shaped cross-section defined by a first rigid member and a second flexible member extending in a direction substantially parallel to said first member at a predetermined distance therefrom and connected to the first member at a first extremity thereof. The second part has a projecting member substantially wedge-shaped in cross-section and extending into the channel to form the mechanical connection between the first and second part. The wedge has a maximum height in the direction perpendicular to the rigid and flexible member which slightly exceeds the predetermined distance between the latter. The height decreases in a direction extending toward the first extremity of said flexible member so that the contacting surface between the projecting member of said second part and the rigid member of said first part substantially exceeds the contact area between said projecting member of the second part and the flexible member of said first part. As a result of this construction, the flexible member exerts a sealing force onto the projecting member of the second part pressing it against the rigid member, thus creating a tight mechanical seal. In addition, a second or back-up seal is formed at the contact between the flexible member of the first part and the projecting member of the second part of the casing.

In a preferred embodiment, the first part is molded as a single unit, the flexible member being a tapered beam having a substantially decreased cross section at the extremity contacting the projecting member of the second part.

The present invention, as well as additional objects and advantages thereof, will be more fully appreciated from the following detailed description when considered in connection with the accompanying drawing in which:

DESCRIPTION OF THE PREFERRED EMBODIMENT

Figure 3:
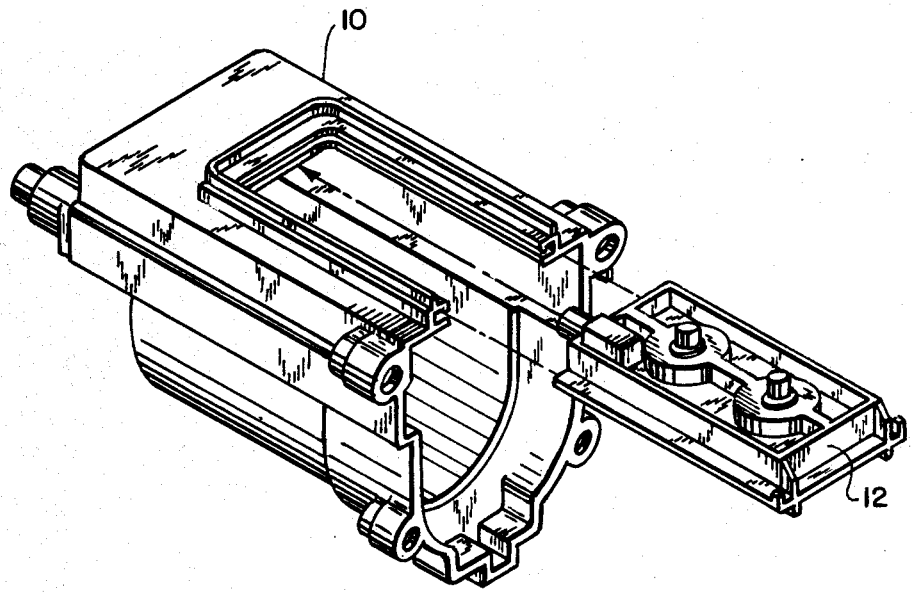
FIG. 3 is an exploded view of a transformer casing and cover to be slidably inserted therein.

The transformer casing shown in an exploded view in FIG. 3 consists of a main casing (or first part) 10 and a cover (or second part) 12. The cover is to slide into the main body in the direction of the arrow. Since the body of the casing contains heated liquid epoxy potting material after the cover is inserted, a liquid-tight seal must be established between the cover and the body of the casing to prevent leakage of the potting material.

Figure 1:
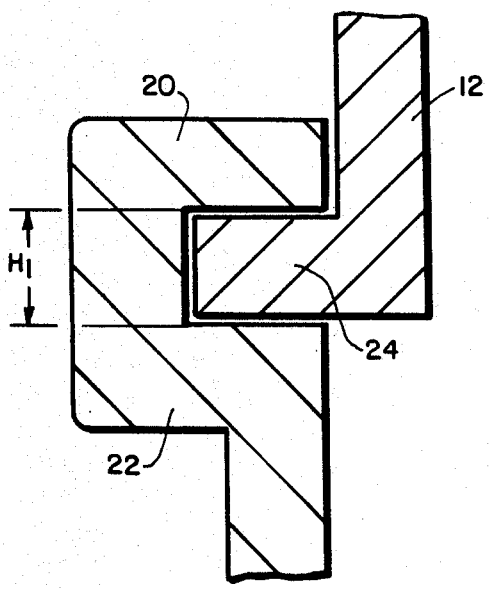
FIG. 1 is a cross-sectional view of a prior art mechanical joint between cover and case.
Figure 2:
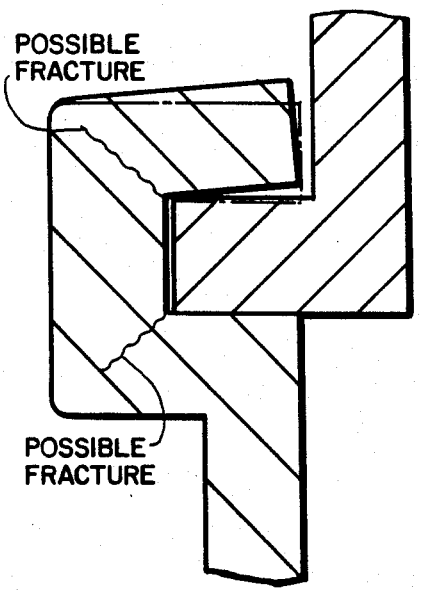
FIG. 2 is a cross-sectional view indicating problem areas for the mechanical joint shown in FIG. 1.

Although transformers casings of the above-described type have been commercially available for approximately 6 years, sealers or adhesives were used during production because of potting compound leakage. The prior art mechanical seal illustrated in FIGS. 1 and 2 illustrate the reason for such leakage. The channel in the main casing is defined by a first and second member, 20, 22 extending in a direction parallel to one another and separated by a distance H forming the height of the channel. Cover 12 has a projection or lip 24 which extends into the channel and whose height is somewhat smaller than the distance H between members 20 and 22. It must be noted particularly that member 20 and 22 have a similar cross-section, both cross-sections being sufficiently large to render the members rigid. With two such rigid members, a clearance must be left between cover and case, i.e. the distance H between the facing surfaces of members 20 and 22 must slightly exceed the height $H_1$ of the cover projection. In the design, the clearance must have a sufficient magnitude to compensate for tolerances in the size of the parts introduced by the molding process. It must further allow for variations in flatness of the mating surfaces of cover and case. These required clearances make a mechanical seal impossible.

A deliberate design interference to allow mechanical sealing would be impossible with this prior art transformer casing, since first, it would require very high force to slide the cover into the case and, secondly, a highly stressed corner would be created (see FIG. 2) which could easily result in breakage.

Figure 4:
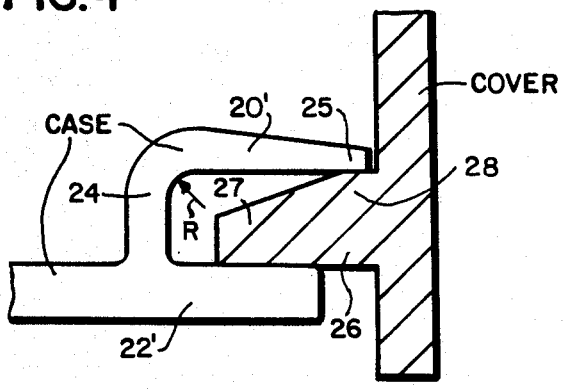
FIG. 4 is a cross-sectional view of the mechanically sealing joint of the present invention.

The above-mentioned problem is avoided by the construction of the present invention as will be explained with reference to FIG. 4. In FIG. 4, the case has a first member 22' which is rigid as it was in the case illustrated in FIGS. 1 and 2. As previously, the second member 20' is connected to member 22' at one extremity 24. However, the cross-sectional area of second member 20' decreases as the member extends from its first extremity 24 in a direction parallel to the first member to form a U-shaped channel. The decrease in cross-section causes the free end portion 25 of member 20' to be flexible. Additionally, a lip 26 which projects from the cover and is to be inserted into the U-shaped channel has a first portion 27 with wedge-shaped cross-section and a second portion 28 with a rectangular cross-section. Specifically, the cross-sectional area of wedge-shaped portion 27 decreases as it extends into the channel in the direction towards the bottom of the "U". The wedge shape is such that contact is maintained with rigid member 22' after contact with flexible member 20' is made. The flexibility of member 20' permits design interference between cover and case without creating undue stress in the member. Further, it causes a downward sealing force to be applied to projecting member 26, so that its bottom surface is tightly pressed against the top surface of member 22'. A liquid-tight seal is thus formed.

If, contrary to expectation, liquid does escape through the seal formed by members 22' and 27, such liquid would still be sealed into the unit by the back-up seal formed by contact between portion 28 of lip 26 and flexible end portion 25 of member 20'.

The stress at the corners noted in the prior art joint can be further reduced by rounding the junction of the flexible member with the base of the U with a radius R. Similarly, the junction with the rigid member should be somewhat rounded to prevent stress concentration. Finally, the maximum cross-section of the flexible member is maintained at the first extremity to absorb stress safely.

In the preferred embodiment, the legs of the U forming the channel extend in the horizontal direction. The U could also extend in a vertical direction, but gravity or some other force might in that case cause separation between the mating parts unless some external lock were added to the design.

In a preferred embodiment, just as in the prior art, the channel forming members are a molded unit, as is the cover with its projecting member or lip.

A preferred embodiment may be described as follows:

Material: PBT (20% glass) Celanese 3210

Length of rigid member: 0.100 inch

Length of elastic member: 0.100 inch (decreasing cross-section only)

Distance between rigid and flexible member: 0.057/0.060 inch

Maximum height of projecting portion of cover: 0.064 inch

Taper of projecting member: 6°

Length of contact of projecting member and rigid member: 0.068 inch

Length of contact of projecting member and flexible member: 0.040 inch

It is seen that by means of the present invention, a liquid-tight mechanical seal can be achieved reliably, without requirement for additional parts or changes in the manufacturing process of a transformer and without use of additional sealing compounds.

While the invention has been illustrated in a preferred embodiment, various modifications and changes in the structure and operation thereof will be evident to one skilled in the art and are intended to be encompassed in the following claims.

I claim:

1. A transformer casing oomprising:

a first part having a rigid first member, and a flexible member extending in a direction substantially parallel to said rigid first member at a predetermined distance therefrom and connected to said rigid first member at a first extremity thereof, said rigid first member and said flexible member together forming a channel;

a second part having a rigid projecting member adapted to be inserted into said channel, said rigid projecting member having a first portion clearing said flexible member and having a wedge-shaped cross section, said projecting member further having a first surface for contacting said rigid first member to form a liquid-tight seal; and wherein said first part of said casing and said second part of said casing together constitute a housing containing hot potting compound.

2. A transformer casing as set forth in claim 1, wherein said first portion comprises said first surface, and wherein said projecting member further has a second portion adjoining said first portion and having a second surface for contacting said flexible member to form a backup seal.

3. A transformer casing as set forth in claim 2, wherein said second portion of said projecting member has a substantially rectangular cross-section.

4. A transformer casing as set forth in claim 3, wherein said first surface is at a second distance from said second surface, said second distance being at least equal to said predetermined distance.

5. A transformer casing as set forth in claim 2, wherein said first surface has a first surface area and said second surface has a second surface area; and wherein said first surface area exceeds said second surface area.

6. A transformer casing as set forth in claim 1, wherein said rigid member has a predetermined cross-sectional area; and wherein said flexible member has a first end portion including said first extremity, and a free end portion, said free end portion having a second cross section having a second cross-sectional area smaller than said predetermined cross-sectional area.

7. A transformer casing as set forth in claim 6, wherein said second cross-sectional area decreases continuously in the direction extending toward said second surface of said projecting member of said second part.

8. A transformer casing as set forth in claim 1, wherein said first part including said flexible and rigid members is formed as a single unit.

9. A transformer casing as set forth in claim 1, wherein said cover has ribs to help prevent excessive warpage.

* * * * *